United States Patent [19]

Pouyez

[11] Patent Number: 4,471,190

[45] Date of Patent: Sep. 11, 1984

[54] DRAWBACK DEVICE CONTROLLED BY LIQUID SURFACE TENSION, A SWITCH INCORPORATING SUCH A DEVICE, AND ITS USE IN MAGNETIC RELAYS

[75] Inventor: Philippe Pouyez, Suresnes, France

[73] Assignee: Socapex, Suresnes, France

[21] Appl. No.: 341,628

[22] Filed: Jan. 22, 1982

[30] Foreign Application Priority Data

Jan. 23, 1981 [FR] France ..... 81 01293

[51] Int. Cl.[3] ..... H01H 29/00

[52] U.S. Cl. ..... 200/191; 200/182; 200/234; 200/235; 335/56

[58] Field of Search ..... 335/47, 48, 49, 50, 335/51, 52, 53, 54, 55, 56, 57, 58; 200/182, 183, 191, 192, 234, 235

[56] References Cited

U.S. PATENT DOCUMENTS

| | | | |
|---|---|---|---|
| 2,312,672 | 3/1943 | Pollard, Jr. | 200/234 |
| 3,144,533 | 8/1964 | Donath | 335/58 |
| 3,343,110 | 9/1967 | Grobe | 335/58 |
| 4,085,392 | 4/1978 | Lacis et al. | 335/58 |
| 4,114,006 | 9/1978 | Tedeschi | 200/234 |
| 4,148,000 | 4/1979 | Lacis et al. | 335/58 |
| 4,236,129 | 11/1980 | Lacis et al. | 335/55 |
| 4,375,055 | 2/1983 | Holvoet et al. | 335/56 |
| 4,400,671 | 8/1983 | Legrand | 335/56 |

FOREIGN PATENT DOCUMENTS

| | | | |
|---|---|---|---|
| 1257285 | 12/1967 | Fed. Rep. of Germany . | |
| 2392485 | 12/1978 | France . | |
| WO79/00532 | 8/1979 | PCT Int'l Appl. | 335/57 |

OTHER PUBLICATIONS

"New Construction for a Mercury-Wetted Switch for Operation in any Position", by Legrand and Frances, vol. 2, p. 625, of Proceedings of the Tenth International Conference on Electric Contact Phenomena.

*Primary Examiner*—Stephen Marcus
*Assistant Examiner*—Ernest G. Cusick
*Attorney, Agent, or Firm*—Cushman, Darby & Cushman

[57] ABSTRACT

A drawback device to ensure the return of a moving part to its original position, after it has been moved away from it by another force. The existing method, involving an elastic mechanical component which acts as a spring, is replaced in this invention by a quantity of liquid, placed between the moving part and a fixed part, and remaining there through the effect of capillarity. When the moving part moves away from the fixed part, surface tension is created on the surface of the liquid, tending to draw the moving part back to its original position. Such devices are used in sealed miniaturized relays with mercury-wetted contacts.

4 Claims, 5 Drawing Figures

DRAWBACK DEVICE CONTROLLED BY LIQUID SURFACE TENSION, A SWITCH INCORPORATING SUCH A DEVICE, AND ITS USE IN MAGNETIC RELAYS

BACKGROUND OF THE INVENTION

This invention concerns a device to draw back a moving component, a switch incorporating such a device, and its use in magnetically operated relays. More specifically, it concerns a device to draw back a moving component which can adopt at least two different positions, an "on" position under the effect of an external force, and an "off" position, under the effect of a drawback force.

Such devices frequently consist of a component possessing elastic properties, and which is usually described as a spring. Such a spring may be a flat plate spring, or a coil spring. More specifically, monostable switches, with a stable position (the "off" position) and an unstable position (the "on" position), in which the switch is held by the effect of an external force (a magnetic field in the case of a relay) often comprise a metal blade or flat spring to return the switch to the stable position.

The spring used in such cases is usually formed of a material differing from that of the moving part, to which it is soldered or fixed in some other way. In the case of miniaturized relays, increasingly used in electronics, this flat spring is extremely small and therefore difficult to handle, and its position difficult to adjust accurately. The same difficulties arise in attaching the moving component, and in general in all operations involving such tiny springs.

Such springs are also quite expensive, being made from specific materials such as beryllium copper and further requiring special treatment to bestow them with adequate elasticity.

Finally, any mechanical spring is subject to aging, which alters its elastic properties after a certain lapse of time.

This new drawback device overcomes such disadvantages.

Further details on the operation of switches such as the one illustrated in FIG. 2 may be obtained from the article entitled "New construction for a mercury-wetted switch for operation in any position" by Legrand and Frances, published in Volume 2, pp. 625 to 634 of the "Proceedings of the Tenth International Conference on Electric Contact Phenomena", held in Budapest from 25th to 29th Aug. 1980.

SUMMARY OF THE INVENTION

This device is characterized by the fact that it comprises a liquid placed between the moving part and a fixed part, the distance between these two parts not exceeding the value for which the liquid is held between the two parts by the forces of capillarity, and the surfaces of both parts in contact with the liquid being dampened or wetted by the said liquid, i.e. absorbent.

The liquid is preferably mercury, particularly when the device is used as a switching device in a relay with mercury-wetted contacts. In this specific case, the invention is especially advantageous, since the enclosure inside which the switch is located normally already contains mercury. This mercury accordingly performs the double function of wetting the relay contacts, and of acting as drawback device for the moving part. The moving and/or fixed parts are preferably in the form of flat metal strips. The moving strip may move either by a translation motion under the effect of an external force, such as a magnetic field, when it is made from a material sensitive to such a force, or by rotating, for example on a pivot contained in a plane surface forming part of the fixed strip.

In one recommended embodiment, the fixed part is formed of a dihedron-shaped component, one of the planes being fixed to a base parallel to the axis of rotation of the moving part, with an opening for this moving part, which is in the form of a strip located on the same side as the second plane of the dihedron, in relation to the first. This embodiment is extremely convenient from an industrial point of view, since the dihedron is obtained simply from a sheet, preferably of metal, in which an opening is cut and which is then folded into two sections, at approximately right angles to each other. The pivot of the moving part, which is placed in a recess in the base, preferably containing mercury, is then held in position by the plane of the dihedron containing the opening. It is thus quite simple to produce such a switch industrially, using a plate containing an opening, and folded at right angles, and a base such as a transistor base with its make and break contacts, and in which a recess is machined. The pivot of the moving part is placed inside this recess, and the plane of the dihedron containing the opening is placed over it, and fixed to the base, so that it holds the moving part, allowing it only to rotate. A drop of mercury is then inserted into the cover, which is soldered to the base.

In another embodiment available to someone skilled in the art, the mercury may be added after the cover has been soldered in position on the base, through one of the electrodes in the form of a hollow cylinder.

All surfaces are treated to make them mercury-absorbent, so that it flows into the recess, allowing the moving part to rotate easily, and also between the moving and fixed parts. If a reducing gas is admitted before the case is closed, the drawback device will be unaffected by aging.

Information on the distance that should be left between the moving and fixed parts, in order to ensure that the liquid will act by capillarity, may be obtained from the standard work on physical mechanics by G. Bruhat (Masson & Cie, Paris, 1934, pp 470 et seq).

The principle of this invention is based on the law of physics known as Jurin's Law.

The switches described above can be used in many circumstances. For example, they can be employed in monostable or bistable magnetic relays, or relays with several different stable positions. The moving strip will rotate under the effect of an external force, coming into contact with one of the mercury-wetted electric contacts. The position will remain stable, as long as the drawback forces exerted by the liquid on the moving strip is less than the force of capillary attraction on the upper part of the moving strip, level with the contact.

Anyone skilled in the art will have no special difficulty in determining the various parameters of such a switch, by applying Jurin's Law, and the theorem of motions.

BRIEF DESCRIPTION OF THE DRAWINGS

It will be easier to understand the invention from the following description of some of the possible embodiments, with reference to the accompanying figures.

DETAILED DESCRIPTION OF A PREFERRED EMBODIMENT

Figure 1:
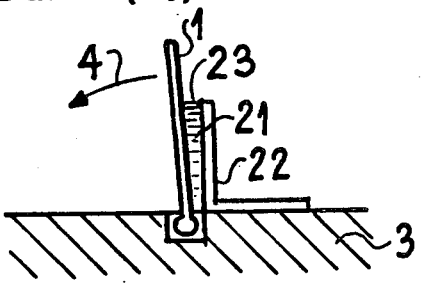
FIG. 1, illustrating the two phases of movement of a moving strip under the effects of liquid surface tension, in the form of two views, a and b.
Figure 1:
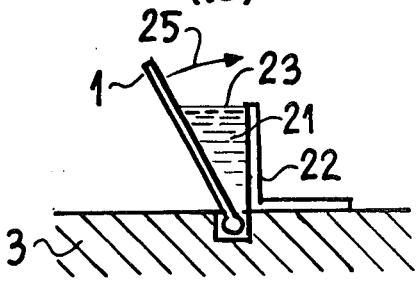

In the two views in FIG. 1, the drawback device comprises a liquid (21), a certain quantity of which is located between the strip-shaped moving part (1) and the fixed part (22) facing it, attached to the base (3).

The distance between the two parts is such that the liquid remains there by the effect of capillarity, and movement of the strip (1) between the close position (a) and the distant position (b) causes a change in the external surface area (23) of the liquid. As described below, this creates a drawback force which tends to bring the two parts together, in the direction of the arrow (25).

The device operates as follows. The distance between the moving part (1) and the fixed part (22), under the effect of an external force, confers potential energy on the system, as a result of the increase in the external surface area of the liquid, which, when the external force is removed, returns the moving part to its original position, by releasing this energy through reduction of the surface area of the liquid and return to the state of minimum internal energy.

This effect is obtained when the two parts (1 and 22) are small enough and close enough together for the liquid to rise under the effect of surface tension forces, and for the force resulting from the effect of gravity on the moving part to be small enough in relation to the surface tension involved.

The energy stored up as a result of movement of the moving part (1) is equal to:

$$dW=\gamma\times dA$$

where dW is the variation in internal energy in the droplet of liquid when the moving part moves under the effect of an external force;

dA is the variation in the external surface area of the liquid resulting from movement of the moving part;

$\gamma$ is the surface tension coefficient of the liquid.

Since the drawback force exerted on the moving part (1) depends on the energy stored, and the distance (3) between the moving part (1) and the fixed part (22), this drawback force depends directly on four factors:

height of the capillary rise of the liquid between the two parts;

respective dimensions of the two parts;

distance between the two parts;

nature of the liquid (The effect of gravity may be ignored for small components, like those hermetically sealed in miniaturized switches). For further details on these parameters, see the work by Bruhat already referred to.

On advantage of this system is its stability in time, eliminating as it does all stress on mechanical components.

Another advantage is that the mechanical parts (1 and 22) need not possess any particular elasticity.

Yet another advantage is that, for small systems such as miniaturized hermetic switches, there is no need for a precise soldered connection between the moving part (1) and the base (3).

Figure 2:
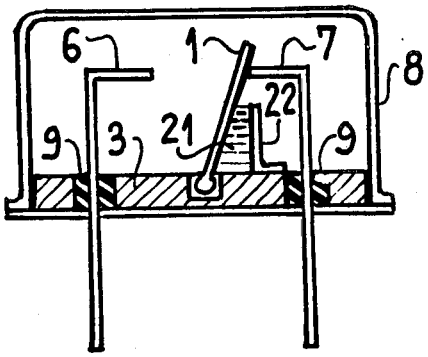
FIG. 2, showing an enclosed switch with mercury-wetted contacts, incorporating the new drawback device.

FIG. 2 illustrates an embodiment of the drawback device used in a miniature switch with mercury-wetted contacts.

The switch comprises a hermetic enclosure, entirely wetted inside, and obtained by fitting a cover (8) over a base (3) comprising two electrodes (6 and 7), insulated from the base (3) by insulators (9), and a moving strip (1), which comes into contact with either electrode (6 or 7).

A fixed strip (22) is positioned on the base (3) near the moving electrode (1), so that the liquid (22) rises by capillarity between the two parts (1 and 22).

In the absence of an external force, the moving part (1) always comes to rest against the fixed electrode (7), because of the drawback force exerted by liquid surface tension. The moving part (1) comes into contact with the "on" electrode (6) only when a force outside the system, for example a magnetic force, takes effect.

Figure 3:
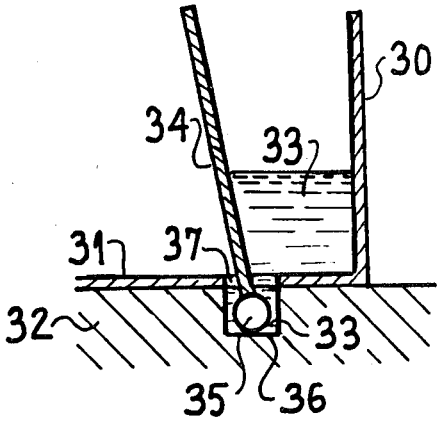
FIG. 3, showing a cross-sectional view of a recommended embodiment of the invention.

FIG. 3 shows a very enlarged view of a recommended embodiment of the invention. The base (32) is covered with a flat metal plate (31), containing an opening (37) for the moving strip (34), the pivot (35) of which is located in a recess (36) in the base (32). The base plate (31) is connected to another surface (30), at approximately right angles to it, and with which it forms a dihedron. Liquid (33) is contained between the two strips (34 and 30), and in the recess (36). The surfaces of the two strips (34 and 30) in contact with the liquid are treated to make them absorbent. The drop of liquid placed on the base plate (31) above the recess (36) rises between the strips (34 and 30) by capillarity, to a height that depends on the various parameters specified above. In this figure, the distance between the two strips (30 and 34) has been exaggerated, to illustrate the phenomenon on which the invention is based. The various component parts are not drawn to scale.

Figure 4:
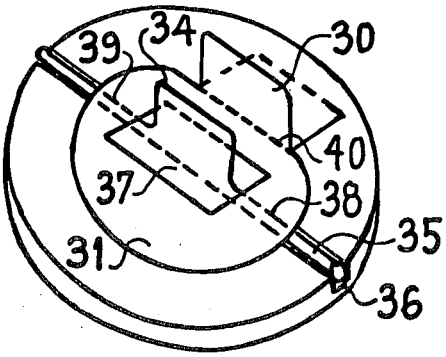
FIG. 4, showing an overhead view of the device illustrated in FIG. 3, before the plate is bent to form the fixed part.

FIG. 4 shows a diagrammatical view from overhead of the device shown in FIG. 3, using the same references for the same parts. The difference in the device illustrated here is that the fixed strip (30) has not yet been bent up to form a dihedron with the base plate (31). This illustrates the simplicity of such a device, using the recommended embodiment of the invention. An enclosed switch like the one illustrated in FIG. 2, for example, can be obtained by taking a base (32), such as a T05 transistor base, making a slot (36) in it, then placing the pivot (35) of the moving strip (34) inside this recess. The flat sheet (30 and 31), containing the opening (37), which is slightly wider than the moving strip (34), is then placed on the base, so as to hold the pivot (35) inside the recess (36), using the side of sheet (31), which cover the parts of the axis shown in dotted lines (38 and 39). The dihedron is then formed, by bending the plate from the position shown in dashed lines along the dotted line (40). A drop of mercury is placed inside the cover fitting on to the base, and cover and base are sealed together hermetically, without protective gas, in order to prevent oxidation of the mercury. To simplify the figure, the electric contacts, illustrated in FIG. 2, are not shown here.

This new switch is operated by means of at least one coil, or permanent magnet, positioned near the case containing the switch, to pull the moving strip into the "on" position. The manetic force applied to the strip to pull it into this position will be regulated to suit the parameters of the switch. When the magnetic field is removed or reduced, the strip returns to the "off" position, through the effect of the liquid drawback device.

What is claimed is:

1. A switch comprising:

an enclosure including a base defining a recess and a cover, said base and said cover each being internally treated to be mercury wettable;

at least first and second electrical conductors extending through said base and being separated therefrom by insulation means;

a fixed plate having a first plane of a dihedron-shaped component and a second plane integral with said base and insulated from said first and second conductors;

a movable plate pivotally connected to said base for pivotal movement along an axis defined by the accommodation of an edge of said movable plate in said recess, said base being a third electrical conductor;

a quantity of mercury placed between said fixed and movable plates which are wetted by said mercury which is held between said plates by capillarity action and applying a force to said two plates so as to bias said movable plate toward a first position in order to create an electrical contact between said movable plate and said first electrical conductor, said movable plate being movable in the presence of a magnetic field to a second position where it is in electrical contact with said second electrical conductor, and being drawn back to said first position by said liquid in the absence of a magnetic field; wherein said fixed plate defines an opening through which said movable plate passes, said axis about which said movable plate pivots being retained in said recess by said second plane.

2. A switch according to claim 1, wherein said second conductor is wettable by said mercury, said movable plate having such shape and the quantity of mercury being such that said second position is a stable position.

3. A switch according to claim 2, wherein said enclosure is hermetically sealed.

4. A switch according to claim 1 in which said mercury is substantially absent between said movable plate and said second electrical conductor.

* * * * *